United States Patent [19]

Mathieu et al.

[11] 4,295,759

[45] Oct. 20, 1981

[54] DEVICE FOR THE CONTROL OF THE INTERNAL PRESSURE IN A DRILL PIPE FOR THE CONSTRUCTION OF FOOTINGS

[75] Inventors: Hans Mathieu; Jürgen Hochstrasser, both of Saarbrücken, Fed. Rep. of Germany

[73] Assignees: Elisabeth Hochstrasser geb. Wack; Jürgen Hochstrasser, both of Fed. Rep. of Germany

[21] Appl. No.: 118,504

[22] Filed: Feb. 4, 1980

[30] Foreign Application Priority Data

Feb. 7, 1979 [DE] Fed. Rep. of Germany ..... 2905042

[51] Int. Cl.[3] ..... E02D 15/04

[52] U.S. Cl. ..... 405/243; 91/50

[58] Field of Search ..... 405/223, 233, 240, 243, 405/269; 91/47, 50

[56] References Cited

U.S. PATENT DOCUMENTS

| | | | |
|---|---|---|---|
| 2,996,888 | 8/1961 | Rice | 405/243 |
| 3,130,552 | 4/1964 | Bodine | 405/240 X |
| 3,216,328 | 11/1965 | Peterson | 91/50 X |
| 3,385,070 | 5/1968 | Jackson | 405/243 |
| 4,044,844 | 8/1977 | Harris et al. | 91/50 X |
| 4,158,518 | 6/1979 | Rusche | 405/240 |

*Primary Examiner*—David H. Corbin

*Attorney, Agent, or Firm*—Basile, Weintraub & Hanlon

[57] ABSTRACT

A device for the control of the internal pressure in a drill pipe or tremie is disclosed. The tremie is used in footings and especially in the construction of compressed concrete footings. The tremie has a valve located in a lid that serves for the tight seal of the tremie. The valve is subjected to a counter-pressure which is greater than the effective power of the internal pressure of the tremie. A hoisting cable is connected to the valve stem and the power of the hoisting cable under normal operating conditions in combination with the internal pressure of the tremie is large enough to overcome the counterpressure. The valve is shifted to vent the internal pressure of the tremie when the same is rapidly removed from the footing bore due to a decrease in ground friction.

9 Claims, 2 Drawing Figures

7

9
10
12
6
28
4
14
5
11
3
20
17
15
18
8
13
16
2
19
29
1
30

DEVICE FOR THE CONTROL OF THE INTERNAL PRESSURE IN A DRILL PIPE FOR THE CONSTRUCTION OF FOOTINGS

BACKGROUND OF THE INVENTION

I. Field of the Invention

The present invention is concerned with a device for the control of the internal pressure in a drill pipe or tremie for the construction of footings and especially in the construction of compressed concrete footings.

II. Description of the Prior Art

For the construction of compressed concrete footings the sunken drill pipe or tremie is sealed tightly at its upper end by means of a lid. Then compressed air is blown into the space which exists between the fresh concrete and the lid with which the drill pipe or tremie is sealed off. This amount of compressed air, which is enclosed in the drill pipe or tremie, results in a compression of the concrete which will cause a smoothing of the concrete with the ground when the drill pipe or tremie is withdrawn by means of a crane cable. In addition, the amount of compressed air assists in the withdrawal of the drill pipe or tremie by means of a cranecable due to the pressure at the bottom of the lid. The utilization of such an amount of compressed air in the drill pipe or tremie is potentially dangerous insofar as the friction of the drill pipe or tremie can suddenly be very much reduced, depending on the present friction in the ground and also depending on the rush of the ground water. This results in a sudden great acceleration of the drill pipe or tremie due to the effect of the amount of compressed air on the lid bottom in the direction of the withdrawal and the drill pipe or tremie will shoot out of the ground.

Such a sudden acceleration of the drill pipe or tremie is a disadvantage. It will normally result in damaged equipment and the operating personnel is endangered.

As a remedy for this disadvantage devices are known which serve for the control of the air pressure which exists inside the drill pipe or tremie during its withdrawal, and which devices are equipped with a valve which is affected by the internal pressure of the drill pipe or tremie in the direction of closing, and which valve opens in case of an acceleration of the upward movement of the drill pipe or tremie.

In case of one such known version (DE-PS No. 656 837) two such valves are provided in the lid which seal the drill pipe or tremie, which valves function in cooperation with a stop which is attached in a fixed position in relation to the drill pipe or tremie and by means of which stop the valves are opened when the drill pipe or tremie has moved a distance, which was determined previously. When the valves are opened, the internal pressure which exists in the drill pipe or tremie is relieved and, thus, the acceleration of the drill pipe or tremie is prevented or at least limited. This known version does not guarantee a dependable control of the internal pressure which exists in the drill pipe or tremie since in case of an acceleration momentum of the drill pipe or tremie which is too strong, the stop will be torn off and, therefore, the safety relief valve will be closed again immediately due to the internal pressure, such that the internal pressure is practically not released.

Another version (DE-PS No. 1 189 021) is known which eliminates the above described disadvantage where also a valve is provided in the lid of the drill pipe or tremie, which valve is in the direction of closing subjected to the internal pressure of the drill pipe or tremie, and which valve is further subjected to a counterpressure, the effective power of which counterpressure is larger than the power of the internal pressure. A hoisting cable is connected to the stem of the valve, the power of which hoisting cable in the direction of closing of the valve is adjustable, and which power under normal operating conditions in combination with the internal pressure of the drill pipe or tremie is large enough to overcome the counterpressure. The valve stem is equipped with a valve hat of smaller diameter which serves to seal the inner space of the drill pipe or tremie in case of the lifting of the valve hat. The inner space of the drill pipe or tremie is connected with venting holes which are located in the valve housing for the purpose of relief of the internal pressure. In addition, the valve stem is equipped with a ring-shaped piston of larger diameter, which ring-shaped piston forms a counterpressure chamber with the valve housing and the counterpressure chamber is connected with the inner space of the drill pipe or tremie by means of a drilled hole, which drilled hole is located axially in the valve stem, and which drilled hole extends through the valve head.

Because of the larger surface of the ring-shaped piston in comparison to the smaller surface of the valve hat, the pressure of the counterpressure chamber which is directed in the opening direction of the valve is always larger than the internal pressure of the drill pipe or tremie which is directed to the opposite direction, and the necessary additional power which is necessary for the maintaining of the closed position of the valve is added by means of the pull of the hoisting cable in the closing direction. As long as this proportion of forces exists at the valve, the upward motion of the drill pipe or tremie can be accelerated by means of its internal pressure. One must only take care that the force of the hoisting cable which acts on the valve in combination with the internal pressure of the drill pipe or tremie is sufficient at any time to overcome the counterpressure; however, this stable condition changes if the external forces which act on the drill pipe or tremie are suddenly reduced, such as, for instance, the friction between the wall of the drill pipe or tremie and the external ground or the poured concrete. In this instance the drill pipe or tremie is accelerated in the upward direction to a greater extent than before and the pull of the hoisting cable becomes ineffective; however, as a result of this the counterpressure which acts on the valve is greater, such that the valve hat is lifted and the internal pressure of the drill pipe or tremie is reduced and, thus, the acceleration of the drill pipe or tremie is stopped.

If the pull of the hoisting cable is represented with "Ps" and the internal pressure with "Pi" and the counterpressure with "Pg," the valve is closed if the following condition has been met:

$$Pg - Pi \leqq Ps < Pg$$

The pulling force of the hoisting cable must be controlled within these limits at a predetermined velocity if the valve should not release any compressed air from the inner space of the drill pipe or tremie. If the pulling force of the hoisting cable is reduced although the withdrawal speed of the drilling pipe or tremie was not increased, the valve will blow off and the withdrawal procedure is interrupted.

This known device, which is equipped with a valve, which valve is subjected to a counterpressure, has several disadvantages which endanger the operational safety. The most significant disadvantage consists in the fact that in case of lifting of the valve hat by means of the counterpressure, the counterpressure chamber is instantaneously relieved of pressure through the axial drilled hole of the valve stem. The rough operating conditions, which cannot be avoided when work with drill pipes or tremies is done, result in a danger of contamination of the valve by contaminants or soils which could consist, for instance, of cement, and which contaminants enter the valve housing and adhere to the inner wall of the valve housing and obstruct and hinder the complete opening of the valve due to the instantaneous relief of the counterpressure chamber which occurs already when the valve hat is lifted. Over a longer period of operation these contaminants can accumulate in the valve to such an extent that an opening of the valve by means of the counterpressure chamber is practically impossible and, thus, the internal pressure which exists in the drill pipe or tremie cannot be relieved. This disadvantage occurs especially in case of the construction of tilted compressed concrete footings where additional auxiliary equipment for the withdrawal of the pipe is used, such as, for instance, hydraulic pressure cylinders which are attached to the drill pipe. Therefore, the known valve does not guarantee an unobjectionable operation and, therefore, the upward acceleration of the drill pipe or tremie cannot be controlled in the necessary manner. Another disadvantage of the known valve consists in the fact that the valve hat strikes hard against its seat at the valve housing when the valve is closed by the hoisting cable, depending on the velocity of the hoisting cable which can amount to more than 0.7 meters per second. Due to this very sudden and very hard striking of the valve hat against its seat area, damage to the valve hat itself or damage to the valve seat area can easily occur, and which make a dependable operation impossible. In addition, the hard striking results in an annoying noise. Furthermore, it is another disadvantage of the known device that it is possible to blow compressed air into the inner space of the drill pipe or tremie when the valve is closed and before the lid is tightly connected with the drill pipe or tremie. In this way the lid can be lifted from the drill pipe. This can result in damage to the lid or damage to the drill pipe and, on the other hand, it represents a danger for the operating personnel.

SUMMARY OF THE INVENTION

The invention is based on the objective to eliminate the disadvantages of the known device and to further develop the known device in such a way that when the valve is opened by means of the counterpressure, it is reliably opened to its full extent, also for the purpose of self-cleaning, and that when the valve is closed by means of the hoisting cable, a damaging hard striking of the valve hat at its seat area is avoided with a simultaneous silencing effect. It is a further objective of the invention to develop the device in such a way that the passing of compressed air into the drill pipe or tremie is possible only then when the lid is tightly connected with the drill pipe or tremie.

This problem is solved in accordance with the invention in such a way that a check valve is located in the axial drilled hole, and that a parallel line is provided which constitutes a restrictor, and which parallel line extends through, for example, the ring-shaped piston and the valve hat. When compressed air is passed into the drill pipe or tremie when the valve is closed by means of the hoisting cable, the counterpressure chamber of the valve is instantaneously filled with compressed air and the check valve which is located in the axial drilled hole is lifted up. When the valve is opened by means of the counterpressure chamber after the pressure in the drill pipe or tremie is relieved, the check valve prevents an instantaneous pressure relief of the counterpressure chamber, since the pressure which exists in the counterpressure chamber can only be reduced slowly through the parallel restrictor. As a result of this the valve is immediately lifted up because of the effect of the counterpressure when the internal pressure of the drill pipe or tremie is eliminated and, subsequently after a delay due to the counterpressure which is reduced slowly, the valve opens to the complete open position. This results necessarily in a self-cleaning of the valve at each opening movement since the contaminants are reliably removed at each opening movement. When the valve is brought into the closed position by means of the hoisting cable and when there is no pressure in the drill pipe or tremie, the check valve remains closed and, therefore, the air of atmospheric pressure which is located in the counterpressure chamber is compressed in such a way that the closing of the valve by means of the increasing pressure in the counterpressure chamber is delayed to such an extent that a hard striking of the valve hat at its seat area is avoided, and also the annoying noise which is caused in this way is eliminated. The air which was compressed in this way in the counterpressure chamber passes slowly through the restrictor into the space inside the drill pipe above the concrete and then the space inside the drill pipe above the concrete can be filled with compressed air.

Another feature of the invention is characterized by the fact that at the circumference of the lid a ring-shaped flange is located, which ring-shaped flange is equipped with at least one venting hole, and that a ring-shaped groove is located at the end zone of the inner surface of the drill pipe or tremie, and that a ring-shaped structure is provided on the top of the ring-shaped flange, which ring-shaped structure can be inserted into the groove, and which ring-shaped structure can be locked in the inserted position, and which ring-shaped structure closes the venting holes of the ring-shaped flange in the locked position, and which ring-shaped structure functions in the way of a snap ring. Compressed air, which was passed into the drill pipe or tremie by error and with closed valve, escapes through the venting hole which is located in the ring-shaped flange of the lid until the snap ring which serves as a connection between the lid and the drill pipe or tremie is engaged in the groove and until it is set in the engaged position. When the snap ring is set in the engaged position, the vent holes of the ring-shaped flange are necessarily closed. In this way it is reliably prevented that an amount of pressurized air can be accumulated in the drill pipe or tremie prior to the tight connection of the lid with the drill pipe or tremie. The ring-shaped structure which functions as a snap ring consists preferably of four segments in the shape of a circular arc, which are inserted into the groove of the drill pipe or tremie, and which tightly connect the lid with the drill pipe or tremie.

In the case of one version the segments in the shape of a circular arc are inserted manually, one after the other, into the groove, and in the inserted position they form a ring-shaped structure; that is, a closed circle. In order to prevent slipping of one or several segments in the shape of a circular arc out of the groove especially in the case of tilted drill pipes or tremies, the segments which were inserted in the groove must be locked in place. The vent hole, which is provided in the ring-shaped flange of the lid, serves for the purpose of locking. This vent hole is located in such a position that it comes in contact with the inner circumferential wall of one segment when the segments are inserted into the groove.

A locking pin, such as, for instance, in the shape of a screw, is inserted in this vent hole. The locking pin seals the venting hole and, on the other hand, the locking pin locks the ring segments in the position in which they were inserted.

In case of another version the ring-shaped segments can be inserted into the ring-shaped groove by means of remote control. In this case the segments in the shape of a circular arc are attached on the ring-shaped flange of the lid in such a way that they are movable in a radial direction, and expanding devices are located between each two adjacent segments which move in contact with the groove. A drilled hole is located in at least one ring-shaped segment in such a way that the venting hole, which is provided in the ring-shaped flange, is in alignment with the drilled hole of the segment when the ring segments are in the unlocked position; however, when the segments are in the locked position, it is closed by the segments. This also guarantees that compressed air, which erroneously has been passed into the drill pipe or tremie, can escape if the lid is not locked. The expanding devices consist of lever arrangements which are attached to the ends of each two adjacent ring-shaped segments which can be actuated externally in actually any way by means of a cable by hydraulic or pneumatic piston and cylinder arrangements or by a remote-controll motor in order to move or shift the ring-shaped segments in the shape of a circular arc which are not in contact with the ring-shaped groove in radial direction until they are in contact with the groove. If pneumatic piston and cylinder arrangements are used, the compressed air which builds up in the counterpressure chamber during the closing movement of the valve can also be used for the operation in such a way that during the closing movement of the valve by means of the hoisting cable, simultaneously, the segments in the shape of a circular arc are brought into contact with the groove such that, in case of subsequent addition of compressed air in the drill pipe or tremie, their lid is connected and locked tightly and securely with the drill pipe or tremie. The attachment of the lid with a snap ring which contacts a groove of the drill pipe or tremie is of special importance when turning devices are used which are connected to the drill pipe or tremie, and by means of which turning devices the drill pipe or tremie is subjected to blows in a tangential direction, and where the rigidly attached lid is always accelerated just as much as the drill pipe and, in addition, the fastening devices are subjected to a lot of stress. When the lid is attached by means of a snap ring which contacts a groove of the drill pipe or tremie, the lid remains in its place due to the moment of inertia and the snap ring is not subjected to stress due to blows or impacts in a tangential direction.

In order to limit the possible maximum amount of air in the drill pipe above the concrete, a high-pressure relief valve can be provided in the lid which can be adjusted to a predetermined maximum pressure.

In order to prevent the occurrence of accidents by an airstream which can escape in the direction of, for instance, a scaffold in case of a sudden release of air from the space in the drill pipe above the concrete and through the openings which are provided in the valve housing, guiding devices which deflect the airstream, such as, for instance, bevels or tube turns, are located outside the venting holes. These guiding devices can be equipped with a lining or casing which has a muffling or dampening effect on the noise which is generated when the air escapes. Perforated sheet metal can, for instance, be used for this noise muffling lining or casing. The space which exists between the deflecting plates or tube turns and the perforated sheet metal can be filled with mineral wool.

The valve hat is axially guided by end pieces which are located at the lid such that a canting or twisting cannot occur. This is especially important for tilted pipes where an unobjectionable guidance of the valve should be assured.

BRIEF DESCRIPTION OF THE DRAWINGS

The enclosed drawings show examples of versions of the device, and the following figures are shown.

DESCRIPTION OF THE PREFERRED EMBODIMENTS

Figure 1:
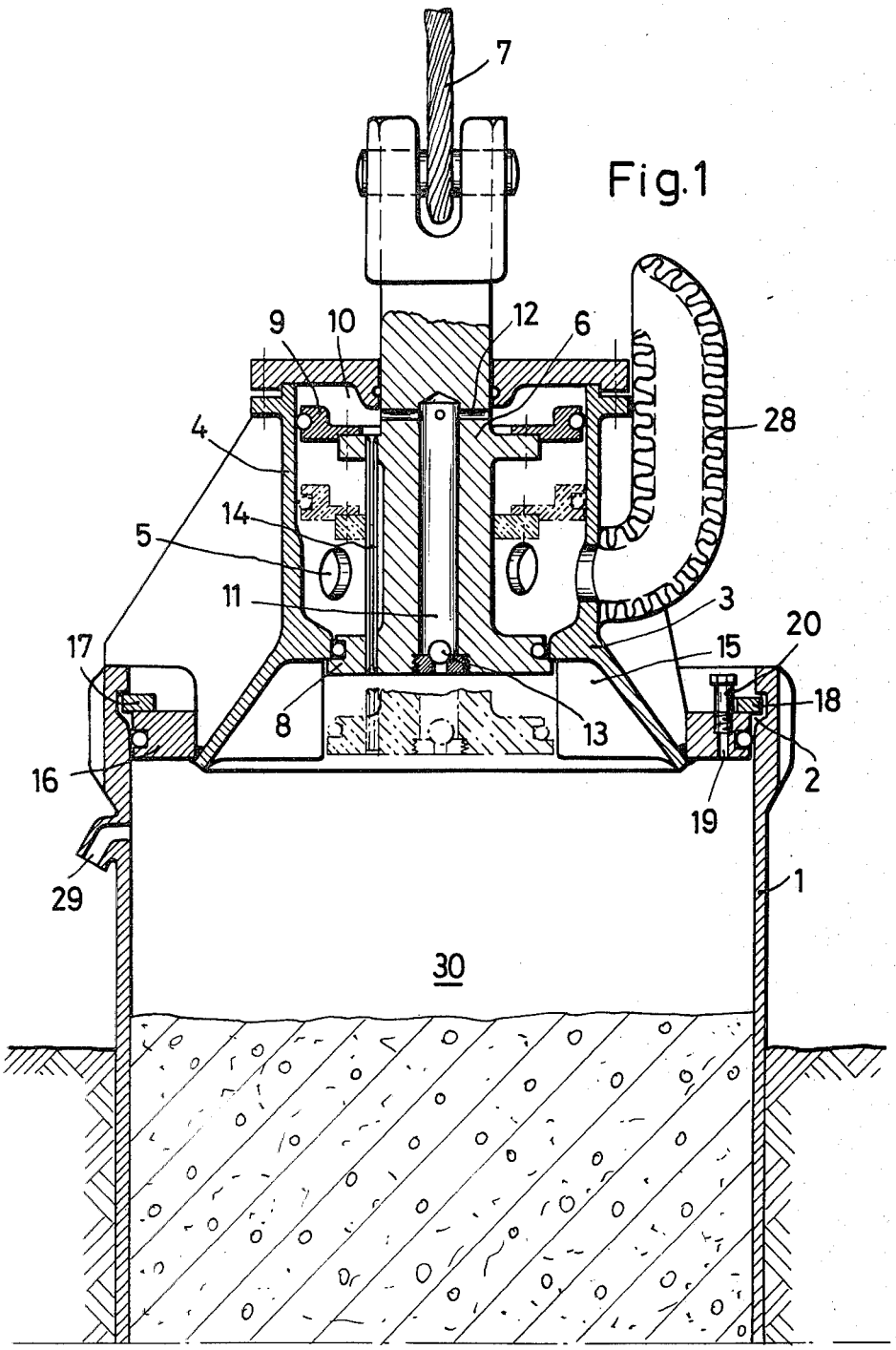
FIG. 1 is a vertical cross-section showing the device which is located on a drill pipe or tremie with one version of the snap ring and where the valve is shown in the form of a solid line in the closed position and where the valve is shown in a dash and dotted line in the opened position.

FIG. 1 shows the upper portion of the drill pipe or tremie 1 which has been sunken into the ground and the inner space of which drill pipe is filled with concrete. At the end and at the inner surface of the drill pipe or tremie 1 a ring-shaped groove 2 is provided. The drill pipe or tremie 1 is sealed by a lid 3 which supports the valve housing 4. Air vent openings 5 are located in the wall of the valve housing 4. A valve stem 6 is located in the valve housing 4, which valve stem 6 is supported by a hoisting cable 7, and which valve stem 6 is positioned inside the valve housing 4, and which valve stem 6 can be adjusted higher or lower.

A valve hat 8 is located at the lower end of the valve stem 6. A ring-shaped piston 9 is attached at the valve stem 6 in the valve housing 4 above the valve hat 8. The ring-shaped piston 9 exhibits a larger diameter than the valve hat 8, and the ring-shaped piston 9 forms a counterpressure chamber 10 together with the valve housing 4. The valve stem 6 is equipped with an axial drilled hole 11 which extends through the valve hat 8, which drilled hole is connected with the counterpressure chamber 10 by means of lateral drilled holes 12. A check valve which is equipped with a ball 13 is located in the valve hat 8. In addition, a pipe 14 is provided which forms the restrictor, which pipe 14 extends, for instance, through the ring-shaped piston 9 in the valve hat 8. The valve hat 8 is axially guided by means of guiding end pieces 15 which are located at the lid 3.

The lid 3 is equipped at its circumference with a ring-shaped flange 16, which ring-shaped flange 16 contacts the inner wall of the drill pipe or tremie 1 with a gasket. A ring-shaped structure 17 is located at the top of the ring-shaped flange 16, which ring-shaped structure 17 consists of several segments in the shape of a circular arc. In order to connect the lid 3 with the drill pipe or tremie 1, the segments 18 in the shape of a circular arc are manually inserted, one after the other, into the groove 2. A vent hole 19 is located in the ring-shaped flange 16. After the segments in the shape of a circular arc 18 are inserted, the vent hole 19 is closed by means of a locking screw 20, which locking screw 20 simultaneously keeps the segments in the shape of a circular arc 18 in their position in such a way that they cannot slip out from the groove 2. When the valve stem 6 is kept in the closed position by means of the hoisting cable 7, which closed position is drawn in a solid line, a valve hat 8 closes the valve housing 4. Then, compressed air is passed through the connection piece 29 into the chamber 30 which is formed in the drill pipe or tremie 1 above the concrete. The hoisting cable 7 will slacken when, during the withdrawal of the drill pipe or tremie 1 by means of the hoisting cable 7, the drill pipe or tremie receives a momentum in the upward direction in case of a reduction of the resistance or friction of the ground due to the effect of the air pressure which exists in the chamber 30. Now, the valve stem 6 is moved down due to the effect of the pressure which exists in the counterpressure chamber 10 and the valve hat 8 is lowered in such a way that the compressed air, which is contained in the chamber 30, is released to the atmosphere through the openings 5. Since the pressure which exists in the counterpressure chamber 10 is not released immediately because of the closed ball-type check valve 13, but can rather be reduced only slowly through the parallel pipe 14 which functions as a restrictor, the valve stem 6 is brought into the complete opened position which is shown with a dash-dotted line with a time delay. The further withdrawal of the drill pipe or tremie 1 can take place now solely by means of the hoisting cable 7.

In this case the valve stem 6 is at first brought into the closed position, which is shown with a solid line, by means of the hoisting cable 7 where the closing takes place with a certain delay, since the pressure which builds up in the counterpressure chamber 10 can be reduced only slowly through the parallel pipe 14. In this way it is avoided that the valve hat 8 strikes very hard at its seat in the valve housing. If the further withdrawal of the drill pipe or tremie 1 should take place with the additional effect of the compressed air, compressed air is again passed into the chamber 30 via the connection piece 29. In which case the process, which was described above, is repeated when the drill pipe or tremie 1 is subjected to a new acceleration impulse which is directed upward. Tube-shaped guiding devices 28 are located at the air exit openings 5 of the valve housing 4, by means of which tube-shaped guiding devices 28 the air is guided and directed in such a way that it does not represent any danger for the operating personnel. The inner surfaces of the guiding devices 28 can be equipped with a noise muffling material.

Figure 2:
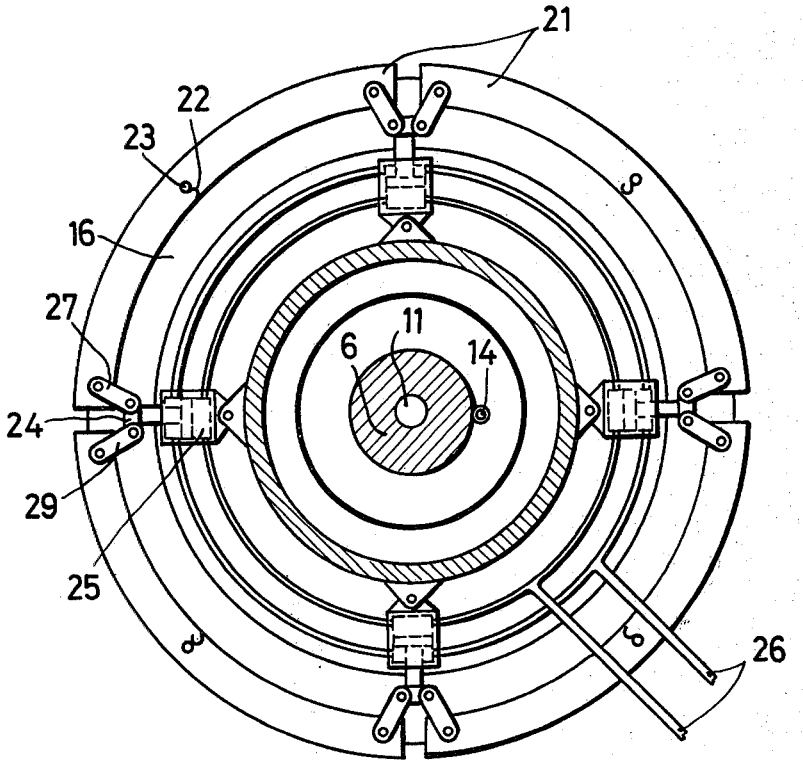
FIG. 2 is a horizontal cross-section showing the device in accordance with FIG. 1 with a modified version of the snap ring.

FIG. 2 shows a modified version of the snap ring type, ring-shaped structures 17. Four segments in the shape of a circular arc 21 are placed on the top of the ring-shaped flange 16 of the lid 3, which segments in the shape of a circular arc 21 are connected with each other by means of expanding devices 24, which expanding devices 24 are connected by means of lever arrangements 27 at the ends of each two adjacent segments in the shape of a circular arc 21. The expanding devices 24 are actuated by means of the piston-cylinder arrangements 25, which in turn are actuated by means of compressed air through lines 26. The piston-cylinder arrangements 25 are attached to the lid 3 in such a way that the segments in the shape of a circular arc 21 can be moved in a radial fashion on the top of the ring-shaped flange 16. In order to connect and lock the lid 3 with the drill pipe or tremie 1, the segments in the shape of a circular arc 21 are moved outward by means of the expanding devices 24 until they are in contact with the groove 2 of the drill pipe or tremie 1. Venting holes 22 are located in the ring-shaped flange 16, which venting holes 22 are in alignment with drilled holes 23, which drilled holes 23 are located in the segments in the shape of a circular arc 21, and which alignment occurs when the segments in the shape of a circular arc 21 are unlocked; that is, when they are retracted. In this way the compressed air which was passed into the chamber 30 can escape when the lid 3 is unlocked. When the segments in the shape of a circular arc 21 are shifted or moved into the groove 2, the venting holes 22 are closed by the segments 21, as it is shown in FIG. 2.

We claim:

1. Device for the control of the internal pressure in a drill pipe for the construction of footings especially of compressed concrete footings with a valve, which valve is located in a lid, which lid serves for the tight seal of the drill pipe, which valve is equipped with venting holes, which valve is subjected to the internal pressure of the drill pipe in the direction of closing, which valve is subjected to a counterpressure, the effective power of which counterpressure is greater than the effective power of the internal pressure and where a hoisting cable is connected to the valve stem, the power of which hoisting cable is adjustable in the closing direction, and the power of which hoisting cable under normal operating conditions in combination with the internal pressure of the drill pipe is large enough to overcome the counterpressure, and where the valve shaft is equipped with a valve hat of a smaller diameter, which valve hat serves to seal the inner space of the drill pipe, and where the valve shaft is further equipped with a ring-shaped piston of larger diameter, which ring-shaped piston forms a counterpressure chamber with the valve housing, and where the counterpressure chamber is connected with the inside of the drill pipe by means of a drilled hole, which drilled hole is axially located in the valve shaft, and which drilled hole extends through the valve hat, characterized by the fact that a check valve (13) is located in the axial drilled hole (11) and that a parallel line (14) is provided which extends through the valve hat (8) and the ring-shaped piston (9), and which parallel line constitutes a restrictor.

2. The device in accordance with claim 1 characterized by the fact that at the circumference of the lid (3) a ring-shaped flange is located, which ring-shaped flange is equipped with at least one vent hole (19,22), and that a ring-shaped groove (2) is located within the end zone of the inner surface of the drill pipe or tremie (1), and that a ring-shaped structure (17) is provided on the top of the ring-shaped flange (16), which ring-shaped structure (17) can be inserted into the groove (2), and which ring-shaped structure can be locked in the inserted position, and which ring-shaped structure seals the venting holes (19,22) of the ring-shaped flange

(16) in the locked position, and which ring-shaped structure (17) functions in the way of a snap ring.

3. The device in accordance with claim 1 characterized by the fact that the check valve (13) is shaped in the form of a sphere, and that the check valve (13) is located in the valve hat (8).

4. The device in accordance with claim 1 characterized by the fact that the ring-shaped structure (17) consists of a plurality of segments (18,21), which segments are shaped like a circular arc.

5. The device in accordance with claim 4 characterized by the fact that the segments (18) which are shaped like a circular arc form a closed ring-shaped structure (17) when they are inserted into the groove (2), and that the venting hole (19) which is positioned in the ring-shaped flange (16) of the lid (3) is located at the inner edge of a segment (18), and that the venting hole (19) can be closed by means of a locking device (20).

6. The device in accordance with claim 4 characterized by the fact that the segments (21) in the shape of a circular arc are attached on the ring-shaped flange (16) of the lid (3) in a radially movable fashion, and that between each two adjacent segments (21) movable expanding devices (24) are located in contact with the groove (2), and that a drilled hole (23) is located in at least one ring-shaped segment (21) in such a way that the vent hole (22) of the ring-shaped flange (16) is in alignment with the drilled hole (23) of the segment in the unlocked position of the ring-shaped segment (21), however, it is closed in the locked position of the segments (21) by these segments (21).

7. The device in accordance with claim 1 characterized by the fact that the expanding devices consist of lever arrangements (27), which lever arrangements act at the ends of each two adjacent ring-shaped segments which can simultaneously be moved from the unlocked position to the locked position of the ring-shaped segments (21) by means of one of a cable and piston-cylinder arrangements (25), which piston-cylinder arrangements can be subjected to compressed air or the like.

8. The device in accordance with claim 1 characterized by the fact that guiding devices (28) are located at the venting holes (5) of the valve housing (4), which guiding devices (28) guide the stream of air which occurs when the valve hat (8) is opened.

9. The device in accordance with claim 1 characterized by the fact that the valve hat (8) is axially guided in end pieces (15) which are located at the lid (3).

* * * * *